United States Patent [19]

Marton

[11] 4,245,437

[45] Jan. 20, 1981

[54] ROTARY TOOL SUCTION HOUSING

[76] Inventor: Miksa Marton, 3620 Rankin Blvd., Windsor, Ontario, Canada

[21] Appl. No.: 948,305

[22] Filed: Oct. 3, 1978

[30] Foreign Application Priority Data

Nov. 23, 1977 [CA] Canada ..... 291557

[51] Int. Cl.[3] ..... B24B 55/06

[52] U.S. Cl. ..... 51/273

[58] Field of Search ..... 51/273, 268, 170 PT, 51/170 R; 144/252 R; 29/DIG. 84; 30/133

[56] References Cited

U.S. PATENT DOCUMENTS

| | | | |
|---|---|---|---|
| 994,430 | 6/1911 | Tunks | 51/273 |
| 1,714,287 | 5/1929 | Wilson | 51/273 |
| 2,006,108 | 6/1935 | Montuori | 51/273 |
| 3,126,021 | 3/1964 | May | 51/273 |
| 3,654,699 | 4/1972 | Garcia | 30/133 |
| 3,786,846 | 1/1974 | Mehring | 51/273 |
| 4,037,982 | 7/1977 | Clement | 51/273 |
| 4,124,956 | 11/1978 | Levinson | 51/273 |

FOREIGN PATENT DOCUMENTS

| | | | |
|---|---|---|---|
| 1529883 | 10/1978 | United Kingdom | 51/273 |

*Primary Examiner*—James G. Smith
*Assistant Examiner*—Roscoe V. Parker
*Attorney, Agent, or Firm*—Burns, Doane, Swecker & Mathis

[57] ABSTRACT

A vacuum housing for a rotary tool, particularly a hand-held tool such as a grinder, consists of a tubular casing concentrically positioned around the tool. The casing features a telescopic nose portion.

3 Claims, 7 Drawing Figures

ROTARY TOOL SUCTION HOUSING

BACKGROUND OF THE INVENTION

The invention relates to tools such as grinders, drills, sanders and the like and in particular to a vacuum housing for such tools.

In numerous fields of use, serious dust problems are created by the use of rotary tools and this is particularly so in the use of high-speed, pneumatically operated grinders and sanders which normally operate in the 15,000 to 30,000 rpm range. Such fields of use are in the automotive industry where hand held grinders are used to trim fiberglass body panels, sand such panels and generally trim edges, clean holes and cut pieces out of fiberglass. The minute particles of glass fiber created in such operations is a serious health hazard to the tool operators even though the operator wears safety goggles and a mask and in some cases a special suit. Very sharp glass fiber particles still enter the operator's body with the result that substantial discomfort is created through itchiness, etc.

Numerous attempts have been made to develop different types of suction or vacuum devices for carrying away such particles but these vacuum devices generally have been ineffective due mainly to the fact that the point of vacuum is too far removed from the point of work.

SUMMARY OF THE INVENTION

In accordance with the present invention, a substantial advancement in vacuum devices for high speed tools is provided in the form of a vacuum housing for the tool and the housing is so constructed that the vacuum source is the point of work of the tool concerned. In the following disclosure, the invention is described by way of example in combination with a high speed linear tool with a grinding bit therein but the invention is equally applicable to drills, sanders and the like.

In accordance with one aspect, the invention relates to a vacuum housing for a rotary tool and is adapted for connection to a vacuum source. The housing comprises a tubular casing of a greater diameter than the body of the tool and is adapted to be concentrically positioned about the body of the tool and detachably secured thereto. The tubular casing includes a nose portion mounted thereon for telescopic movement relative to the casing itself, the nose having an opening for protrusion therefrom of an operating bit of the tool and spring means are provided intermediate the nose portion and the casing to bias the nose in an extended position.

The invention is illustrated, by way of example, in the accompnaying drawings in which.

Figure 1:
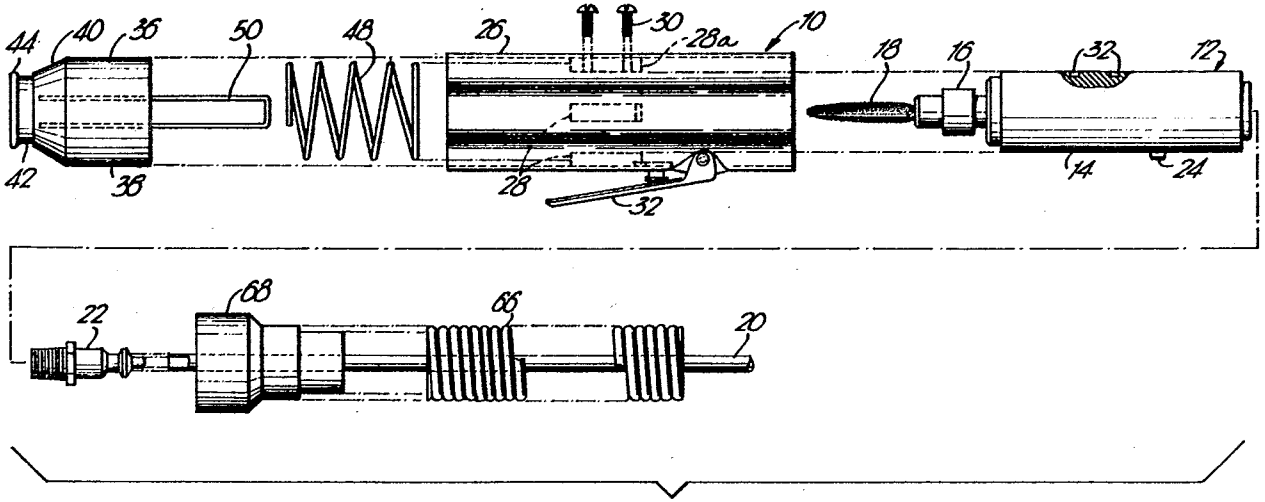
FIG. 1 is an exploded view of the housing according to the invention.
Figure 4:
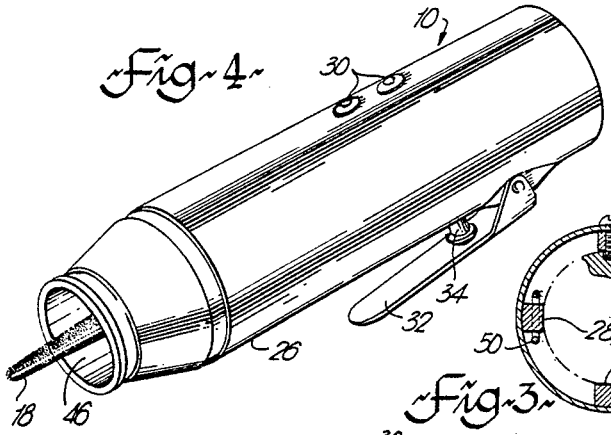
FIG. 4 is a perspective view of the tool with the housing mounted thereon.

Referring to FIG. 1, the housing shown generally at 10 is adapted to be detachably secured to a tool 12, in the case illustrated, a high speed pneumatically operated rotary tool having a tubular body 14, a chuck 16 and a detachable bit such as an abrasive grinder 18. As illustrated in the linear exploded view of this figure, the tool 12 fits inside the housing 10 and is operated by means of air pressure directed through a line 20 and connected to the tool 12 by means of fitting 22. The tool is operated by means of a pushbutton 24 located on one wall of the tool body.

Figure 3:
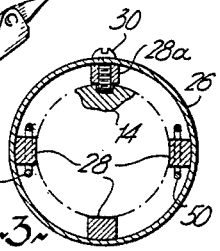
FIG. 3 is a cross-section taken along the line 3—3 of FIG. 2.
Figure 2:
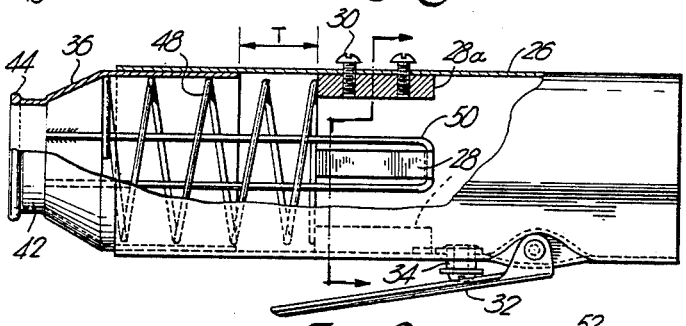
FIG. 2 is a side elevation of the housing, partly in section, in assembled condition but without the tool therein.
Figure 6:
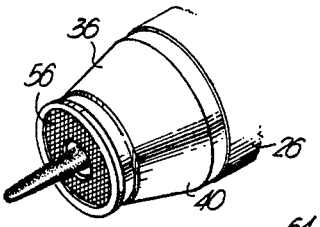
FIG. 6 shows another variation in nose construction.

The housing 10 comprises a tubular casing 26 of substantially the same length as the tool 12, the casing 26 having a plurality of longitudinal ribs 28 spaced around the interior surface of the casing wall as shown more clearly in FIGS. 2 and 3. The uppermost rib 28*a* is threaded to receive at least one or preferably two set screws 30 which, when the tool is placed in position inside the casing 26, are screwed inwardly to engage a pair of cooperating sockets 32 in the body 14 of the tool 12. It will be appreciated that release of these screws allows the tool to be quickly slipped out of the casing 26.

The casing also is provided with a pivotal trigger 32 which, through a free-floating pin 34, serves to operate the actuating button 24 on the body of the tool.

The vacuum housing 10 incorporates a telescopic nose portion 36 having sufficient movement indicated at T in FIG. 2 to allow the grinding bit to be inserted fairly deep into the work and still have the point of vacuum adjacent thereto. Additionally, the resiliency of the nose portion 36 provides an automatic depth gauge to the bit when grinding a depression or hole.

As shown in FIGS. 1 and 2, nose portion 36 has a tubular section 38 that slidably fits within the casing 26 and a converging wall 40 terminating in a tubular flange 42 and bead 44 surrounding the opening 46 where dust particles and the like may be drawn into the housing under vacuum force.

As shown in FIG. 2, the nose portion 36 is biased towards an extended, outward position by means of a coil spring 48 and its outward movement is limited by a pair of elongated U-shaped retainers 50 which are secured at their outer ends to the cone 38 and, at their inner ends engage the rear portion of respective rubs 28 as shown clearly in FIG. 3.

At this point, it will be appreciated that when the grinding bit 18 is rotated at high speed the vacuum presented at the housing opening 46 is immediately adjacent the work and by pushing inwardly towards the work on the body of the casing 26, the nose cone 36 will retract allowing the bit to go deeper into the work.

Figure 5:
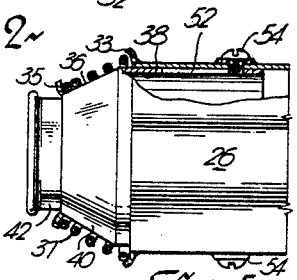
FIG. 5 shows an alternate method of mounting the nose portion on the casing body.

FIG. 5 shows an alternate form of mounting the nose 36 onto the casing wall 26 by means of a pair of longitudinal grooves 52 in the tubular portion 38 of the nose and set screws 54 mounted on the wall of the casing. The terminal end of the casing 26 is provided with a peripheral flange 33 and the outer end of the converging wall 40 is provided with a similar peripheral flange 35. A coil spring 37 of frustoconical shape is mounted between the two flanges 33, 35 to thereby urge the nose portion 36 outwardly. It will be observed that the structure of FIG. 5 eliminates the elongated U-shaped retainers of FIG. 1, allowing more space for movement of the nose 36.

The opening 46 of the nose portion 36 may be provided with a screen 56 to prevent large particles or chunks of fiberglass or the like from entering the inner part of the casing.

Figure 7:
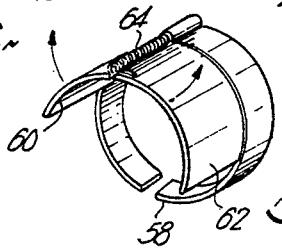
FIG. 7 shows a flexible, deflecting collar which may be mounted on the nose portion.

In FIG. 7, a deflecting device is shown comprising a collar 58 adapted to fit around and be rotatable on the flange 42 of the nose portion 36. The collar 58 carries a semi-circular shroud made up of a pair of quarter panels 60 and 62 connected together by spring means 64. While using a grinding bit or a drum sander, the deflector will overlie the operating tool and will prevent debris from being thrown upwardly away from the vacuum opening 46. However, due to the spring connection 34 between the quarter panels 60 and 62, the shroud may be folded upwardly in the direction of the arrows so that the shroud will not limit downward movement of the grinding tool onto the work surface.

Returning to FIG. 1, the casing 26 is connected to a flexible vacuum hose 66 by means of a stepped connecting collar 68 and the airline 20 which lies in the center of the vacuum hose branches off therefrom at some distance from the housing 10.

It will be appreciated that operation of the tool within the casing 26 provides a vacuum source at the point of work and the debris is drawn by the power of the vacuum around the body of the tool intermediate the outer surface thereof and the inner wall of the casing. I have found in practice that the reciprocal working of the nose 36 in the casing 26 and in particular the working of the spring 48, tends to detach any heavy particles of work that may clog in around the spring and this action releases those pieces to be drawn into the vacuum apparatus.

The housing of the present invention does not interfere either with the tool bit or with the operator. In operation, the operator finds it easier to use the tool inside the casing as high speed rotary tools tend to get very cold due to the temperature of the tool being lowered by the velocity of the driving air. It will be appreciated from FIG. 2 that the tool can be quickly released from the casing simply by unscrewing the two set screws 30 and dropping the body of the tool out through the back of the casing.

I claim:

1. A vacuum housing for a hand-held rotary tool and adapted for connection to a vacuum source, said housing comprising a generally hollow tubular casing of a greater diameter than the body of the tool and being adapted to be concentrically positioned about the body of the tool to encase the same and detachably secured thereto with a space between the body of the tool and the interior of the casing; the tubular casing including a changeable nose portion detachably mounted at one end thereof for telescopic movement relative to the casing itself, the nose having an opening for protrusion therefrom of an operating bit of the tool, a path for air flow being provided from said nose opening at said one end of the tubular casing through said space along the body of the tool to the other end of said tubular casing; spring means provided intermediate the nose portion of the casing to bias the nose in an extended position; and means for connecting a vacuum source to said housing at the end thereof remote from the changeable nose portion and in alignment therewith so that air is drawn through said opening and along the tool body to the collecting means at the far end thereof, the vacuum connection means being coaxially positioned with means for driving the rotary tool.

2. A vaccum housing according to claim 1 including a screen member covering substantially all of the opening in the nose portion with a central aperture therein for protrusion of an operating bit of the tool, said screen preventing large pieces of cut material from plugging up the vacuum housing around the tool.

3. A vacuum housing according to claim 1 and a deflecting device comprising a collar for circumferential engagement on said nose portion, said collar including a semicircular shroud extending forwardly thereof to overlie the operating bit of the tool to prevent debris from being thrown upwardly away from the vacuum opening when said bit is used in a grinding or sanding mode.

* * * * *